United States Patent [19]

Doyle et al.

[11] 3,974,840

[45] Aug. 17, 1976

[54] PORTABLE HOODED HAIR MOISTURIZER AND DRYER

[75] Inventors: Edward J. Doyle, Hatboro; Nial C. Bartram, Lancaster, both of Pa.

[73] Assignee: Schick Incorporated, Lancaster, Pa.

[22] Filed: Nov. 11, 1974

[21] Appl. No.: 522,449

Related U.S. Application Data

[63] Continuation of Ser. No. 299,839, Oct. 24, 1972.

[52] U.S. Cl. ..... 132/9; 34/99

[51] Int. Cl.[2] ..... A45D 1/00

[58] Field of Search ..... 132/9; 34/99

[56] References Cited

UNITED STATES PATENTS

| | | | |
|---|---|---|---|
| 3,362,086 | 1/1968 | McLean | 34/99 |
| 3,550,285 | 12/1970 | Omohundro | 132/9 |
| 3,727,322 | 4/1973 | Walter et al. | 34/99 |
| 3,775,861 | 12/1973 | Waters | 34/99 |

*Primary Examiner*—G.E. McNeill

[57] ABSTRACT

A portable combination moisturizer and dryer which includes a base, a head supporting assembly, and a head assembly into which the rest of the unit can nest for carrying and for storage. The head assembly includes a generally annular air distribution plenum for receiving moisture-laden or drying air and directing it radially inwardly. In a preferred embodiment, a squirrel-cage blower is contained in an impeller housing disposed in the lower portion of the head supporting assembly, which lower portion is mounted for adjustable pivotal movement with respect to the base. The upper portion of the head supporting assembly terminates in a horizontally disposed manifold constituting a portion of the plenum, to provide for passage of either moisture-laden air or drying air through the head mounting assembly and into the interior of the plenum, while also permitting adjustment of the position of the head assembly with respect to the head mounting assembly. The intermediate portion of the head mounting assembly is divided into two separate sections. The air heater is provided in one of the sections which defines the impeller-driven air conduit, and a steam generator is provided in the other section, along with means for directing the generated steam into the horizontal manifold.

10 Claims, 6 Drawing Figures

FIG. 4
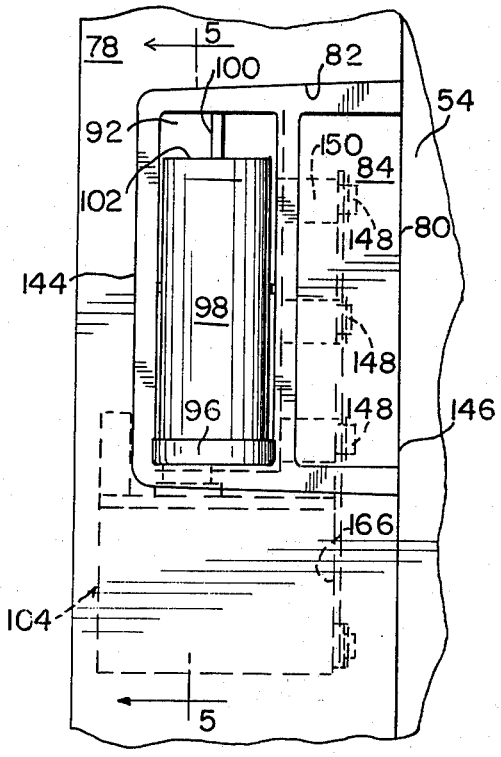
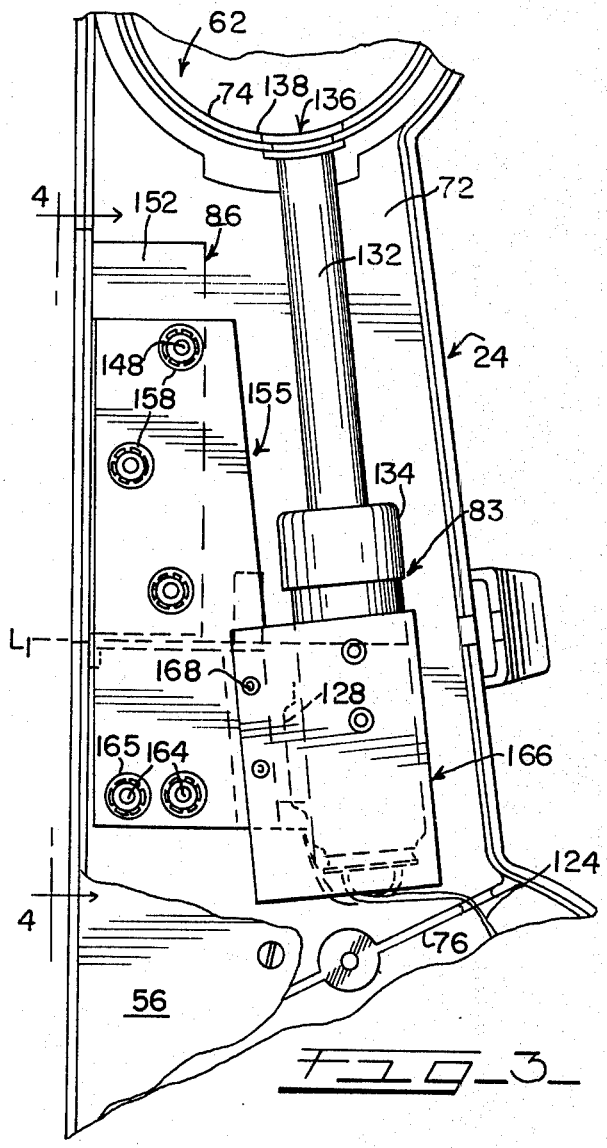
FIG. 3
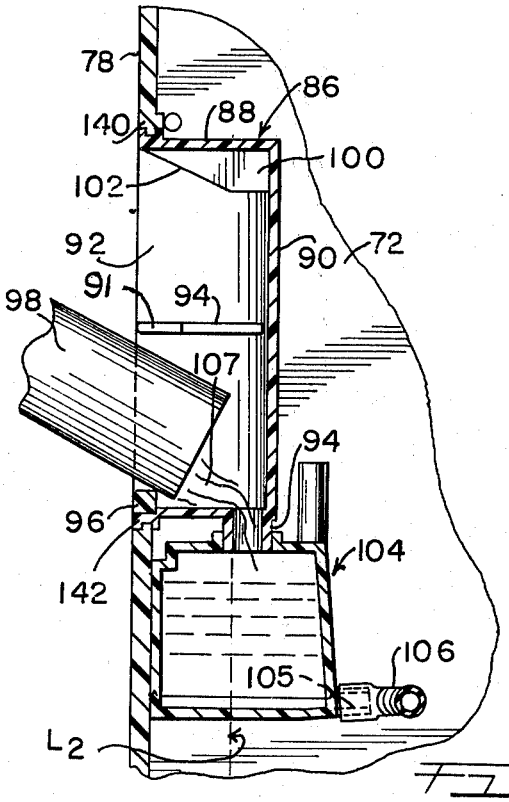
FIG. 5
FIG. 6
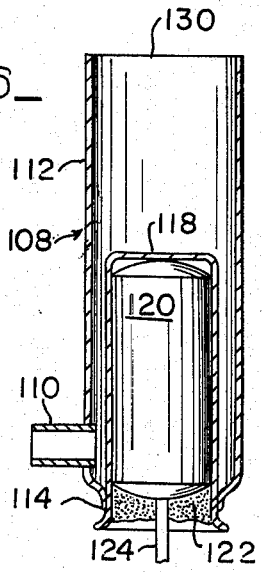

PORTABLE HOODED HAIR MOISTURIZER AND DRYER

This is a continuation of application Ser. No. 299,839, filed Oct. 24, 1972.

BACKGROUND OF THE INVENTION

The present invention relates generally to hair dryers, and more particularly, to portable combination hair moisturizers and dryers. It relates to an improvement in those hair dryers having rigid dryer head assemblies which include portions adapted to surround at least a part of the head of the user and which are occasionally referred to in the trade as "hard hat" hair dryers. A preferred embodiment of the present invention relates generally to hair dryers of the type having the configuration of an articulated, nestable "Z".

Such hard hat dryers are readily distinguishable from other types of dryers such as dryers having flexible bags or caps which surround the head of the user and which include a flexible hose-like conduit extending between the cap and a blower for heated air, and from dryers of the hand-held type, wherein no means are provided for surrounding any substantial portion of the head of the user. Although hair dryers of both the hand-held type and flexible cap type are proven acceptable to the trade, it is well known that hair dryers having the rigid drying head or hood units are superior in use, principally because they are sufficiently rigid to contain a fixed physical structure which serves to direct the air to desired portions of the hair of the user in accordance with a pre-determined pattern. Recently, hair dryers of the rigid hat or hard hat type have become relatively common home appliances, and have certain currency because they have been able to be manufactured at reasonable prices. Such dryers are generally designed so as to overcome the drawbacks associated with commercial or heavy-duty hair dryers, namely, substantial mass, lack of portability, and the requirement of using substantial amounts of electrical current.

The most preferred embodiment of the present invention can be regarded as an improvement over dryers which are disclosed in co-pending U.S. Pat. application Ser. No. 229,763, filed Feb. 28, 1972 by Robert S. Waters, Edward J. Doyle, Meryic K. Rogers, and Nial C. Bartram ans assigned to a common assignee with the present invention. The hard-hat dryer disclosed in that patent application provides a head assembly and a base, each of which are respectively pivotally mounted at opposite ends of the head mounting assembly on parallel horizontal axes in such a manner that the head and the base assembly can be pivoted with respect to the head assembly to nest the base and head mounting assembly within the head assembly, or it can be opened into the general configuration of a Z without requiring dismantling or separation and reassembly of the dryer.

In the dryers described in the aforementioned patent application, the head assembly included an upper shell disposed above and about a generally annular plenum, and this shell is pivotally mounted on a separate horizontal axis to expand the volume generally enclosed by the annular plenum and shell assembly.

As indicated above, hard hat hair dryers have proven acceptable and are eminently satisfactory for use as hair dryers. One of the advantages of the hard hat hair dryers of the type described and claimed in the aforementioned patent application is the fact that these hair dryers readily lend themselves for eminently satisfactory use by a user having a number of relatively large curlers in her hair at the time of use.

While it is not the purpose of the present discussion to elaborate in great detail on all the factors relating to the "setting" of curls in hair, or relating to the effects of moisture on the curling and setting of hair, it has been accepted by the industry and by the consumer public that the best and longest-lasting hair set is obtained by washing the hair, putting it up in curlers wet, and drying it with a hard or soft bonnet type hair dryer. This method introduces the maximum amount of moisture into the hair itself, imparting the maximum set and the longest-lasting curl retention. Utilization of the same step sequence on dry hair produces little or no result.

An alternative method of setting hair which does not involve the washing step as a preliminary, is to provide the same step sequence with dry hair, using rollers with moisture available on the rollers to provide a quick set on drying. This method gives a lasting set of acceptable duration and is one of the quickest and most convenient to do. However, tests have shown that another alternative hair setting procedure which imparts a lasting set which is second in duration only to that achieved by the first procedure involving washing hair, putting it up in curlers wet, and drying it in a hair dryer, is that alternative method in which dry hair is rolled on curlers, moisturized by moisture-laden air mist mixture and then subjected to drying.

While it is not intended that the present invention be bound by, or limited to, any particular chemical theories, at least the following brief explanation of the presently accepted understanding of some of the physical-chemical factors involved in the hair setting phenomenon is deemed to be desirable. Some present authorities regard hair fiber as being made of molecular chains of atoms which are folded upon themselves much like accordian pleats. These authorities believe that some hydrogen bonding occurs between the molecules, and between different portions of the same molecules, and that this bonding is responsible for the characteristic known as hair setting. It is well known that water softens hair and in some instances to such an extent that it can be stretched when totally wet up to several times its initial length without breaking. Furthermore, there is no critical point of full wetness which must be attained before the hair can be so influenced. The ability of hair to be stretched is reported to increase in proportion to the amount of water it has absorbed, either from liquid water, or from water vapor present in the air.

Wetting or hydration of the hydrogen bonds referred to above releases the normal hydrogen bonding attachments within the hair fiber. As a result, moisturization will relax the hair molecular structure by causing the hydrogen bonds to release their hold, allowing the pleats to unfold and the molecules to change position and to bypass each other. One might visualize the hair as a resilient system of fibrous molecules packed together much like the fibers of a strand of hemp rope. Under ambient conditions this system comprises a natural inter-molecular hydrogen bonding mixture of attached hydrogen bonds in equilibrium with some that are not attached. The ratio of the attached to unattached bonds also depends in part on the number of available water molecules within the system. The greater the number of attached bonds (as in dry hair) the harder and stiffer is the system. As more of these hydrogen bonds become unattached (as in moisturized, wetter hair) the system becomes more flexible and more easily stretched.

If hair is bent as when curling, compression stresses develop on the inside of the curve while tension stresses develop on the outside elongated portion of the hair. If hydration moisture is available at the hydrogen bonds resisting these internal stresses these bonds tend to lose their original attachment. The molecular "pleats" in the hair under tension can relax and can be pulled open as a consequence. At the same time some molecules slide slightly along others. Both of these effects occur to reduce the tension stresses developed by bending the hair. In a similar way, the compression stress is also relieved and reduced.

If the hair is now held bent until dry, new hydrogen bonds reform automatically, but at new locations, such as to hold the hair in bent position. Pleats are now held open, or more tightly closed, depending on their configuration at that particular portion of the hair strand when the hair is physically held in the desired curled configuration. Molecules that have shifted in position along others are now also held in their new location. The end result is a new curled configuration of the original hair with little or no molecular "memory" which would tend to cause the hair to return to its pre-setting configuration.

Thus, these physical-chemical explanations by the authorities assist in understanding why wet hair will produce the tightest or longest-lasting curls when dried on suitable curlers. Under these conditions, the greatest number of hydrogen bonds are affected, that is, released and then reformed. However, if hair is not totally wet, then some of the hydrogen bonds are not affected in the curling process, which leads them to strain against those which were effected. This is part of the basis for the molecular memory referred to above which generates internal forces which tend to return the hair to its original pre-curl configuration. Such a situation produces looser or shorter-lasting curls. The more moisture applied at the inception of the curling process, the more effective it is believed that it will be. Hot dry curlers can curl hair under certain conditions, but the curls resulting will depend on the amount of moisture already in the hair at the start of the procedure. Such curls appear because of the drying out of the moisture produced new hydrogen bonds in configuration to hold the curl. However, these bonds will be constantly straining against bonds that were not previously broken, and against compressive or stretching forces that were not previously relieved, and, thus, the curls formed by the hot-dry curlers will not remain as permanently. If moisture is added as in the hot wet curlers, or by means of a moisture-laden airmist mixture, then more hydrogen bonding of the old configuration is released, relieving the internal molecular memory forces. Then, during re-drying, new hydrogen bonding occurs to provide a lasting set to the hair in the new curled configuration.

Thus, when some provision is made to moisturize the hair while it is physically maintained in curled condition, the hair need not be so completely dried out in order to make a substantially longer-lasting curl.

It is generally regarded as undesirable to dry the hair too much, because the dryer the hair, the harder and less flexible it becomes, for the reasons outlined above. If hair can be curled adequately without the need to drive moisture out to a "too dry" level, the resulting curl will be softer, and the hair in the curls will be more resilient and less liable to fracture during the final combing and arranging of the curls. In the final arranging and combing, the hair receives the most severe mechanical abuse. If the hair is too dry at this time, it is more likely to fracture and produce split ends and broken hair shafts. If sufficient moisture is retained in the curl during this stage, it is less brittle and more able to withstand mechanical abuse. It will be appreciated, however, that whatever the true physical-chemical explanations or reasons for the eminently satisfactory results of the operation of the present invention, it is effective, and hence, the present disclosure is not dependent upon any particular theory or explanation as to the physical-chemical phenomenon within the hair itself.

It is an important feature of the present invention to provide a portable means for effectively moisturizing hair while in curlers in conjunction with a portable hard-hat hair dryer.

It is another object of the present invention to provide a hair moisturizer and dryer having a configuration in which a head assembly thereof will occupy the necessary but minimal volume when the hair moisturizer and dryer is in a stored configuration, and yet in which the head assembly can be expanded automatically to provide adequate volume for use by a person having a plurality of relatively large curlers, for example, which combination moisturizer and dryer also provides means for uniformly imparting stress-relieving moisture to the hair.

It is a further object of the present invention to provide a portable combination hair moisturizer and dryer having an easily stored hinged Z configuration, having means for generating and for providing uniform distribution of moisture vapor and mist to the hair, which generating means are supported in the central head-supporting element of the hinged Z and which moisturizer and dryer has a water reservoir configuration such that normal residual amounts of water will tend not to be spilled therefrom when the hinged Z hair moisturizer and dryer is converted to its storage configuration.

It is a further object of the present invention to provide a portable hinged Z hard hat moisturizer and dryer which includes means for providing penetrating water-moisture to all hair surfaces, which means is mounted for long-lasting substantially trouble-free use, and which can be efficiently and economically assembled during manufacture.

It is a further object of the present invention to provide a hair mister-dryer which has the operating configuration of a Z and in which steam generating means are carried in the intermediate head-supporting element.

It is another object of the present invention to provide a hard-hat hair dryer with moisturization means, and also having air impelling and heating means, wherein the blowing and heating means are not subjected to corrosive effects of the generated steam.

It is a further object of the present invention to provide a hard-hat hair steamer and dryer in which hair internal stress is relieved by moisture, wherein the moisture is provided in the form of a concentrated mixture of vaporized water, in air, which mixture also contains a fine mist of extremely tiny droplets, if desired.

These and other objects which will be apparent hereinafter are all achieved in accordance with the present invention which is described herein in connection with a particularly preferred embodiment, and with the aid of the accompanying drawings in which:

FIG. 3 is a sectional view taken approximately along the line 3—3 of FIG. 2.

FIG. 4 is a fragmentary view taken approximately along the line 4—4 of FIG. 3, showing a portion of the back of the dryer shown in FIG. 1.

FIG. 5 is an enlarged fragmentary cross-sectional view taken approximately along the line 5—5 in FIG. 4.

FIG. 6 is an enlarged cross-sectional view taken through the boiler element.

DESCRIPTION OF THE PREFERRED EMBODIMENT

Although it will be understood that the invention may be embodied in a number of different forms, the description thereof will be made with reference to a preferred embodiment wherein a head assembly, which includes a movably mounted cover surrounding a generally annular plenum and an air flow control system is mounted for pivotal movement about a portion of a plenum disposed atop the head mounting unit, the lower portion of which also includes an impeller and a motor housing and which is attached to a base unit. In the preferred construction, air is taken in through openings in the base, and is directed by the impeller upwardly through the head support element past a heater in the head mounting unit for distribution about the periphery of the head within the annular plenum and vents outwardly from the interior of the head under the control of the adjustable cover vents. In this preferred embodiment, the head support element is longitudinally divided by a separating wall into a channel through which the impeller-moved air flows, and into a second compartment in which a steam generating element is housed. For storage and transportation, the cover or shell portion of the head is moved downwardly to a position closely overlying the plenum the mounting unit pivoting relative to the base as well as to the head assembly, to permit both the base and the head mounting unit to be received within the head assembly and retained therein. The steam generating unit and the water-storage component are so designed that, under conditions of use, the pivoting of the moisturizer-dryer to the storage configuration with the base remaining on the horizontal surface will result in a minimum likelihood of any spilled water.

Also, when the dryer is carried or stored in its normal standing storage configuration after use, no water loss or dripping is normally encountered.

Figure 1:
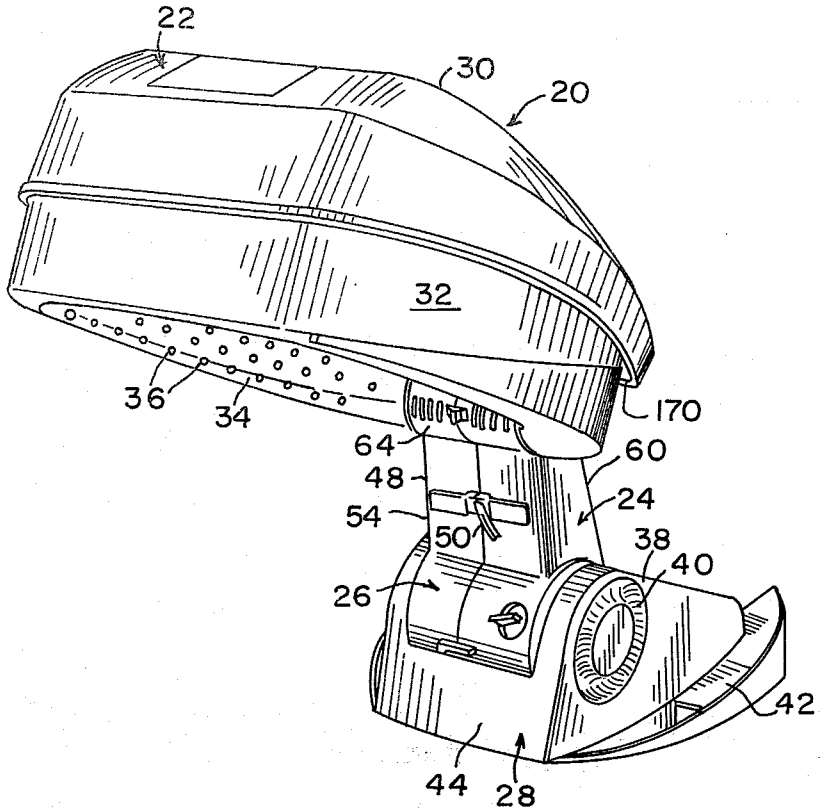
FIG. 1 is a perspective view of a hair moisturizer-dryer of the present invention in operating configuration.

Referring now to the drawings in greater detail, FIG. 1 shows a hair moisturizer-dryer in accordance with the present invention generally designated 20 having a head assembly 22 pivotally mounted atop a head mounting assembly 24, the lower portion of which forms an impeller housing 26 received within a base unit 28. The head assembly 22 includes an upper cover or shell portion 30, and the exterior wall portion 32 of a somewhat elongated generally annular drying air distribution plenum 34 having a plurality of radially inwardly directed openings 36—36 therein. The base assembly 28 includes a pair of legs 38 each having a louvered annular inlet opening 40 for fresh air and each having a tray assembly 42 associated therewith for receiving pins, curlers, or the like. The front wall 44 of the base assembly 28 includes an edge portion 46 of reduced height, permitting the neck portion 48 of the head mounting unit 24 to be placed in various positions with respect thereto.

As indicated above, the preferred steamer-dryer of the present invention is an improvement of the portable hair dryers which are disclosed in co-pending U.S. Pat. application Ser. No. 229,763, referred to above, and the details of the construction of the head assembly 20, the base 28 and the pivotal articulation means by which head assembly 20, head mounting assembly 24 and base 28 are pivoted with respect to each other or are fixed with respect to each other in either the operating or storage configuration are described in detail in the earlier application, and it is believed unnecessary that this discussion be repeated herein. Accordingly, all of the details of that discussion are incorporated herein by reference thereto.

Suffice it to say, however, that impeller housing 26 includes an electric motor (not shown), connected to electrical supply cord 50.

Neck portion 48 is divided into two vertically extending portions thereof including vertically extending plenum 52 defined by the left-hand housing 54 (see FIG. 2) and the mounting plate 56 which is substantially imperforate except for openings 58 in impeller portion 26 through which air passes over the motor (not shown) which is in the right-hand housing 60 and into the left-hand housing 54 in which the squirrel-cage impeller (not shown) is located. The driven air passes upwardly through vertically extending plenum 52 over the heater means 60 mounted on plate 56 and into a horizontally disposed manifold 62 within the upper enlarged end 64 which is pivotally connected to oppositely facing and opening ends 66, 68 of plenum 34 by means of annular pivoting and locking elements 70, the details of which are discussed in the aforementioned patent application. The steam-generator compartment 72 is also positioned within neck portion 48 of head support element 24 and is defined by the right-hand housing 60, the mounting wall 56, upper wall 74 and lower wall 76.

Referring now to FIG. 4, the back wall 78 of the neck portion 48 of head support element 24 is seen, and it will be understood that wall 78 constitutes a back wall of that portion of the housing 60 which defines the steam generator compartment 72. Furthermore, as seen in FIG. 4, the opposing right and left portions 54, 60 of the housing of head support element 24 meet at a midline 80.

As seen in FIG. 4, rear wall 78 is shaped to define an opening therein which extends to midline 80 and which is adapted to receive and support facing insert panel 84. Insert panel 84 is part of an integral molded element generally indicated by the numeral 86 which includes inwardly extending walls 88 and rear wall 90 which define a recess 92. Walls 88, 90 can be provided with ventillating slots 94. Molded element 86 also includes a downwardly extending conduit 94 which serves as a drain for recess 92, and provides a channel communicating with the inward extreme of recess 92. The numeral 96 indicates a press-fit insert which serves the dual function to assist in retaining water being poured into recess 92 and to assist in keeping a large mouth vial 98 in place within recess 92. Ribs 91 extend into recess 92 to retain vial 98 in storage position. Vial 98 is preferably made of transparant plastic such as cellulose acetate. Element 86 also includes detent 100 which tapers upwardly and outwardly and which is positioned to engage the top edge 102 of vial 98 to help retain vial 98 in a storage position (see FIG. 4) in recess 92. The steam generating apparatus 83 of the present invention also includes a reservoir 104 which communicates with conduit 94, and which includes a drain nipple 105 communicating with flexible conduit 106 which, in turn, communicates with a conventional water boiler, which is generally indicated by the numeral 108, by attachment to nipple 110. (See FIG. 2). Boiler 108 consists of an outer generally cylindrical casing 112 having an annular mouth portion 114 for receiving conventional heating element 116 which, in turn, has a metal heat-conducting casing 118, a conventional heater cartridge 120, such as a "Calrod" (T.M.) unit, the details of which will not be discussed herein because conventional, and sealing compound 122 through which electrical cords 124 pass to energize heater 120. Electrical cords 124 communicate with a control switch 126 and with conventional thermostat means 128 (see FIG. 3) positioned against casing 112. The other end 130 of boiler 108 is open, and is in sealed communication with relatively large steam conduit 132. Bell 134 sealingly connects the lower end of conduit 132 to the casing 112, and the upper end 136 of conduit 132 is secured to manifold wall 64 by mating tongue and groove with radially extending flange-like fitting 138. Bell 134, conduit 132 and fitting 138 can be made as an integrally molded unit from any suitable heat and steam resistant plastic such as silicone-based materials such as "Nordel" (T.M. DuPont).

Referring now to the details of the mounting of the respective elements within compartment 72, the edges 140 of panel 84 of molded component 86 are grooved to receive a mating tongue configuration in rear wall 78. It is also noted that opening 82 has a slightly larger dimension along center line 80 than along the opposite edge 144. Thus, it will be appreciated that in assembly molded element 86 is secured to back wall 78 before housing component 59 is mated with housing component 54 by sliding element 86 into chamber 72 with edges 140 mating with edges 142 until the element 86 is seated in the position illustrated in FIG. 4. In this configuration, inner edge 146 falls in alignment with center line 80.

From a consideration of FIG. 4, it will be apparant that three mounting posts 148 have shoulder 150 extend from side wall 152 of molded element 86. A second support plate 156 has openings therein which register with mounting post 150 and plate 156 bears against shoulders 150 and plate 156 is secured against shoulders 150 by fasteners 158—158.

A second set of mounting posts 164—164 extend from wall 166 of reservoir 104 and wall 166 is held in abuttment with plate 156 due to the mating insertion of post 164 through openings in plate 156, with fasteners 166—166 secured to post 164—164 and firmly against the outer surface of mounting 156.

Also secured to mounting plate 156 is a second mounting plate 166 which is secured thereto by a plurality of spot welds 168. Plate 166 is secured to casing 112 of boiler 108, and supports boiler 108.

Thus, the entire steam-generating assembly 83 can be handled as an integral pre-assembly component which, on assembly of the steamer-heater 20, is secured to housing 59 by merely mating molded element 86 into wall 78 and fitment 138 into manifold wall 14, both insertions being made from midline 80, and by making appropriate electrical connections.

OPERATION

In accordance with the use of the present invention, water 170 is preferably poured into reservoir 104 from vial 98 by partially inserting vial 98 into recess 92 past dam 96. Water runs, under force of gravity, into reservoir 104, through conduit 106, and into heater 108. It will be appreciated from a consideration of FIG. 3 that the boiler 108 and particularly casing 112 has been positioned on mounting plate 116 so that the level which is indicated as "$L_1$" in FIG. 3, namely, the level to which the water would rise within casing 112 when reservoir 104 is filled to overflow capacity, is well below the top end 130 of the casing 112 of the boiler 108.

Figure 2:
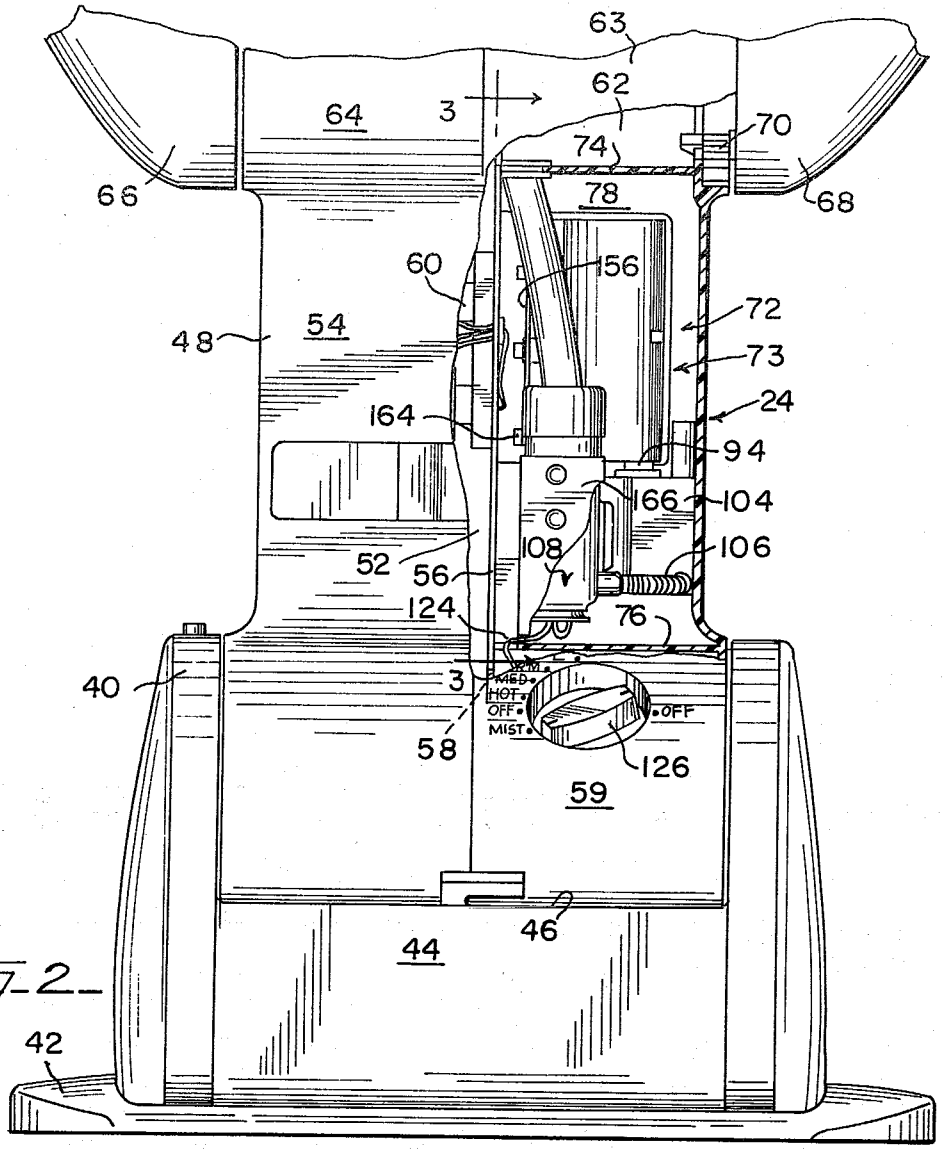
FIG. 2 is a fragmentary enlarged front view of the hair steamer-dryer of FIG. 1, with a portion of the front wall thereof cut away.

Also, in a preferred embodiment of the present invention, the recess 92 is sized to receive a vial 98 having a predetermined capacity such that some particular multiple of that capacity provides the desired maximum filling quantity of liquid in the steam-generating system. Referring now to FIG. 2, the user, after placing the desired quantity of water in the system, can adjust the control switch 126 to the desired operating condition. In the illustrated embodiment, the control switch is shown at "mist" position, and the wiring to switch 126, when switch 126 is in mist condition, can be arranged as desired. For example, in one preferred embodiment, only the steam generating system 73 and, more particularly, heater cartridge 120, is energized when switch 126 is in the mist position. Thermostat 128 is a conventional thermostat which is set to interrupt the power supply to heater cartridge 120 whenever outer casing 112 substantially exceeds those temperatures normally encountered with boiling water at atmospheric pressure. Heater cartridge 120 provides heat which passes through walls 118 to boil the relatively small amount of water within casing 112, and as the water is boiled, the steam passes upwardly through conduit 132 and into manifold 62. It will be appreciated that upon passing into manifold 62 the water vapor will mix with a relatively large amount of air, and it is to be expected that, depending on the temperature of the air in manifold 62, more or less of the vapors will be converted into a mist suspended in the air. However, it is also to be expected that a substantial portion of the vapor will remain in vapor form.

It is also noted that from conduit 132 and particularly end 136, vapor is discharged at the midline 80, so that the vapor is distributed evenly to both sides of plenum 34. It is also noted that in normal operation, head assembly 20 is not positioned with plenum 34 in precisely horizontal attitude, but, rather, it is normally somewhat tilted as illustrated in FIG. 1. Thus, because of the annular configuration of plenum 34, and because of the generally vertical positioning of head support element 24, it will be appreciated that the mist will be carried into plenum 34 and discharged from openings 36 as a result of the "chimney effect" in which some air passes through annular openings 40, and upwardly through plenum 52 into manifold 62 to assist in the efficient and even distribution of the mist-vapor.

Under some normal operating conditions, a certain amount of vapor condensation will take place on the inner surfaces of manifold walls 74, or in plenum 34.

Even this moisture is eventually swept into contact with the users hair, in normal operation, because after the first misting operation in the preferred embodiment, the dryer impeller is activated and the warm air initially vaporizes and sweeps any water of condensation on walls 74, or plenum 34 into the users hair as vapor.

Alternatively, in a second preferred embodiment, switch 126 can be wired so that when heater cartridge 120 of boiler 108 is energized, the impeller fan (not shown) operates on a relatively slow speed, for example, to provide some positive air-sweep factors over and above that which would be encountered with only the natural chimney effect. In another alternative embodiment, the heater 60 could also be energized to provide at least a low level of heat output into the slow speed air sweep while the boiler heater cartridge 120 is energized.

Thus, for the reasons explained above, the user of the moisturizer-dryer of the present invention can advantageously roll portions of her hair around respective rollers, and, positioning her head with the rollers within head assembly 20, cause the rolled hair to become moisturized, and can permit the moisturization operation to continue for whatever time is desired. Thereafter, th user can turn the switch 126 to a setting at which the hair will become dry to cause the rolled hair to achieve a lasting "set".

Thus, the unit 20 operates primarily as a hair moisturizer during a first phase of the operation, and thereafter, the impeller (not shown) and air heater 60 are energized, and the steamer-dryer operates primarily as a hair drying applicance in the latter phase of the process.

It is also noted that in normal operation, most, if not all, of the water which is initially charged to reservoir 104 will be consumed due to the operation of water-heater 108. Nonetheless, should some of the water remain in the system 73 after the user has completed the steaming and drying cycle, the illustrated component layout and design, in accordance with the preferred illustrated embodiment, will prevent water from inadvertently discharging when the dryer 20 is converted to its storage configuration. It will be appreciated from a consideration of FIG. 1 that in order to nest the head bonding assembly 24 and the base 28 within plenum 34, head mounting assembly 24 is pivoted to bring wall 28 in a substantially horizontal position with wall 78 facing downwardly towards base 28. Starting with the configuration shown in FIG. 5, therefore, wall 78 would be rotated 90° to the left when the head mounting assembly 24 is so pivoted, and it will be appreciated that, in spite of this pivoting, residual water will be retained in reservoir 104 at least up to the level indicated by the broken line identified as "$L_2$". Thereafter, upon locking head assembly 20 into nested storage configuration to retain the head mounting assembly 24 and base 26 within plenum 34, the unit 20 is ordinarily lifted by handle 170 for storage in the configuration in which the head mounting assembly 24 is again in the generally vertical orientation shown in FIG. 5. Thus, the nested steamer-dryer of the present invention can be carried about in storage configuration with at least some residual water in the reservoir 104 without any problems in regard to the spilling of the water, and, moreover, the unit can be set up again for use as shown in FIG. 1 without any problem with regard to spilling water from reservoir 104 in the process.

It will be appreciated by those skilled in the art that many modifications and alterations can be made in the disclosed embodiment without departing from the spirit and scope of the present invention, and that the embodiments described in detail herein are provided for illustration purposes and not to limit the invention. The scope of the invention is to be determined from the claims appended hereto. For example, it is to be understood that the types of boiler means can be used without departing from the invention, and many modifications can be made in the moisturizer-dryer configuration without departing from the spirit or scope of the present invention.

We claim:

1. A portable combination hair moisturizer and dryer comprising: a base, a rigid head assembly including an air distribution plenum having means for directing air generally radially inwardly with respect to said head assembly; means comprising a rigid head-mounting assembly including a housing pivotally adjustably secured at respective opposite ends thereof to said base and to said head assembly for supporting said head assembly above said base; means for impelling and heating air; means for directing heated air through said head mounting assembly to said plenum; and steam-generating means including a liquid reservoir mounted in the interior of said housing for directing steam to said plenum.

2. A portable combination hair moisturizer and dryer comprising a base, a head assembly having an air distribution plenum, means comprising a rigid elongated head-mounting assembly including a housing pivotally attached to said base and said head assembly for supporting said head assembly above said base; means for impelling air and first directing means for directing heated air through said head-mounting assembly and into said plenum, said head mounting assembly including means within said housing for dividing the interior of said housing into first and second sections, said first section extending from said base to said head assembly and defining part of said air directing means, said second section having means for generating steam mounted therein for directing steam to said plenum.

3. A portable combination hair moisturizer and dryer comprising, in combination; a base; a head mounting assembly comprising a housing having first and second end portions, said first end portion being received by said base; and a head assembly attached to said second end portion; an air impeller housed within said first end portion; driven-air conduit means in said housing for directing air from said first end portion to said second end portion; means in said second end portion for pivotally engaging said head assembly to permit relative movement between said head assembly and said head mounting assembly; a generally annular plenum formed in part by portions of said head assembly, and in part by said second end portion of said head mounting assembly, said plenum having imperforate exterior walls and plural openings in the radially inwardly directed walls thereof; a cover element disposed over said plenum and defining, with said plenum, the interior of a region into which drying air is directed by said impeller; steam-generator means mounted within said housing including boiler means for converting liquid water into steam, water intake means for receiving liquid water and means for directing water from said intake means to said boiler means, and steam conduit means for directing steam from said boiler means to to said second end portion of said head mounting assembly.

4. The combination hair-moisturizer and dryer of claim 3 wherein pivot means are provided at opposite ends of said head mounting assembly for pivoting said head mounting assembly, said head assembly, and said base to a nesting configuration wherein said mounting assembly and said base are received within said head assembly with a back wall of said head mounting assembly facing in the direction of said base assembly; and wherein said water-receiving means are positioned in said back wall of the mounting assembly and wherein said water receiving means include a recess in said back wall, said recess having a drain and a conduit at the bottom thereof communicating with a water reservoir, the conduit entering the top of the water reservoir at an inward extreme of said reservoir with respect to said back wall, said reservoir having drain means and a second conduit communicating therewith and with said boiler, said boiler including a water-receiving chamber which extends from below the bottom of said reservoir to above the top of said reservoir whenever the head mounting assembly is in generally vertical operating configuration.

5. The combination hair moisturizer and dryer of claim 4 wherein said steam-conduit means direct steam to said second end portion of said plenum and discharge steam therein independently of said driven-air conduit means.

6. The combination hair moisturizer and dryer of claim 4 wherein said head mounting assembly is formed by opposing mating housing elements each having general "O" shaped horizontal cross section when the dryer is in an operating configuration, and which comprises an imperforate interior wall member and means for mounting said interior wall along a midplane at which said head mounting assembly housing elements meet, said interior wall extending along the entire head mounting assembly between said end portions thereof, said interior wall and one of said housing elements defining a portion of said driven-air conduit, the other of said housing elements and said interior wall defining part of a separate compartment for receiving said steam-generator means; said other housing element having an opening in said back wall thereof beginning at and extending laterally from said midplane; and in which said steam-generator means comprises a first molded element having an outwardly facing panel portion thereof in which said recess is positioned, said panel portion and said rear wall around said opening having tongue and groove mating means at opposing surfaces therebetween for insertion of said facing element into said opening of said rear wall from said midplane prior to bringing together of the mating housing elements, said first molded element including mounting means for fixing a mounting plate with respect thereto, said reservoir and said boiler being supported on said second mounting plate, and wherein said steam-directing means includes a flexible conduit terminating in a fitting having tongue and groove mating means for securing said fitting to a wall of said annular plenum.

7. In combination in a portable combination hair moisturizer and dryer having a rigid head assembly, a base, and means comprising a pivotally movable head mounting assembly for supporting said head assembly above said base in an adjustably fixed operating configuration, said mounting assembly including means for pivotally supporting said head assembly at one end portion thereof; a hot air distribution plenum with generally radially inwardly directed air distribution openings therein, said plenum constituting part of said head assembly and part of said one end of said head mounting assembly; means for nesting said combination hair moisturizer and dryer whereby said base and head mounting assembly are pivoted to reside within said head assembly for storage; air impeller means housed within the other end portion of said head mounting assembly, said other end portion of said head mounting assembly including means for pivotally supporting said mounting assembly in said base; said head mounting assembly including driven-air conduit means for directing air from said other end of said assembly to said plenum, said conduit means having positioned therein means for heating the impeller-driven air; said head mounting assembly also including means for generating steam and means for directing steam to said one end of said mounting assembly and into said plenum; and interior wall means for separating said driven-air conduit means from said steam generator means.

8. The moisturizer-dryer of claim 7 wherein said head mounting assembly, said base, and said head assembly are pivotally articulated through pivot means positioned at opposite ends of said head mounting assembly, and provide parallel, horizontal axes of pivot when the moisturizer-dryer is in an operating configuration, and wherein said steam-generating means include a boiler, a water reservoir, and water-receiving means positioned in that portion of that exterior wall of the mounting assembly which faces towards the base when the moisturizer-dryer is in storage configuration, said water-receiving means comprising a recess in said exterior wall, said recess having a drain and a drain conduit at the bottom thereof communicating with said water reservoir, the drain conduit entering the top of said water reservoir at an inward extreme of said reservoir with respect to said exterior wall, said reservoir having a drain and a second conduit communicating with said boiler, said boiler including a water-receiving chamber which extends below the bottom of said reservoir and above the top of said reservoir.

9. The moisturizer-dryer of claim 7 in which said steam-directing means discharges steam into said plenum independently of said driven-air conduit means.

10. The moisturizer-dryer of claim 7 wherein said head mounting assembly is formed by opposing mating housing elements, and includes a mounting wall and means for mounting said mounting wall along the midplane at which said housing elements meet, and in which said steam-generator means comprise a first molded element having a facing portion thereof in which said recess is positioned, said facing portion and a rear wall of said housing having tongue and groove mating means at opposing edges therebetween for inserting said facing element into said rear wall of said housing element from said midplane prior to bringing together of the mating housing halves; said first molded element including mounting means for fixing a second mounting plate with respect thereto; said reservoir and said boiler being supported on said second mounting plate; and wherein said steam-directing means includes a flexible conduit terminating in a fitting having tongue and groove mating means for securing said fitting to a wall of said plenum by insertion into said wall from said midplane.

* * * * *